US007186016B2

(12) United States Patent
Jao

(10) Patent No.: US 7,186,016 B2
(45) Date of Patent: Mar. 6, 2007

(54) LED-TYPE WALL LAMP WITH DECORATIVE LIQUID

(76) Inventor: Chzh-Lin Jao, No.43-4, Ta-Ping Village, San Wan Country, Miao Li County (TW)

( * ) Notice: Subject to any disclaimer, the term of this patent is extended or adjusted under 35 U.S.C. 154(b) by 90 days.

(21) Appl. No.: 11/042,144

(22) Filed: Jan. 26, 2005

(65) Prior Publication Data

US 2006/0164823 A1 Jul. 27, 2006

(51) Int. Cl.
*H01R 33/00* (2006.01)

(52) U.S. Cl. ..... 362/644; 362/101; 362/231; 362/641

(58) Field of Classification Search ..... 362/641, 362/642, 643, 644, 101, 231
See application file for complete search history.

(56) References Cited

U.S. PATENT DOCUMENTS

| | | | | |
|---|---|---|---|---|
| 2,353,063 | A * | 7/1944 | Otis | 40/406 |
| 3,780,260 | A * | 12/1973 | Elsner | 392/392 |
| 4,072,855 | A * | 2/1978 | Marchese | 362/101 |
| 5,926,440 | A * | 7/1999 | Chien | 368/10 |
| 6,241,362 | B1 * | 6/2001 | Morrison | 362/231 |
| 6,416,197 | B1 * | 7/2002 | Chang | 362/96 |
| 6,464,368 | B1 * | 10/2002 | Chen | 362/96 |
| 6,499,853 | B2 * | 12/2002 | Stekelenburg | 362/84 |
| 6,926,426 | B2 * | 8/2005 | Currie et al. | 362/282 |
| 6,955,441 | B1 * | 10/2005 | Chen | 362/96 |
| 6,964,498 | B2 * | 11/2005 | Wu | 362/242 |
| 7,063,431 | B2 * | 6/2006 | Tsai | 362/96 |
| 2004/0160769 | A1 * | 8/2004 | Currie et al. | 362/232 |
| 2005/0201081 | A1 * | 9/2005 | Brady | 362/101 |

* cited by examiner

*Primary Examiner*—Thomas M. Sember
*Assistant Examiner*—Adam C. Rehm
(74) *Attorney, Agent, or Firm*—Lowe Hauptman & Berner, LLP

(57) ABSTRACT

A LED-type wall lamp with decorative liquid consists of a transparent container for liquid on top and a base on bottom. The transparent container for liquid is used to accommodate various kinds of decorative liquid for displaying. Plug pins are disposed on the base projecting outwards so as to connect with an electric socket while a circuit board and a plurality of LED lights with different colors are disposed inside the base. The light emitted from LED lights illuminates toward the bottom of the transparent container for liquid. By the transparent container for liquid, the decorative liquid, and light from LED lights, the present invention has bright and colorful visual effect as well as effects of electricity saving, higher safety and decoration.

3 Claims, 7 Drawing Sheets

LED-TYPE WALL LAMP WITH DECORATIVE LIQUID

BACKGROUND OF THE INVENTION

The present invention relates to a LED-type wall lamp with decorative liquid, especially to a wall lamp that includes a plurality of LED (light-emitting diode) lamps as light source to illuminate a transparent container for liquid with decorative effect so as to increase the safety, decorative effect and electricity-saving effect of wall lamps.

Wall lamps, including general ones or night lamps of similar type, are disposed on the walls of hallways, passages or in rooms. They are controlled by a switch or a sensing switch and are illuminated at night or in the dark. However, conventional wall lamps generally use a small light bulb that generates heat as light sources. Thus the defects of the device are not only electricity consumption but also safety concern after being used for a long time. And a single light bulb being used is single color without variability. Thus it lacks novelty and interestingness.

SUMMARY OF THE INVENTION

Therefore it is a primary object of the present invention to provide a LED-type wall lamp with decorative liquid composed by a transparent container for liquid and a base. The transparent container for liquid is used to accommodate various kinds of decorative liquid for displaying. Plug pins are disposed on the base projecting outwards so as to connect with an electric socket. A circuit board and a plurality of LED lights are disposed inside the base. The light emitted from LED lights illuminates toward the bottom of the transparent container for liquid. In usage, light from LED lights illuminates toward the transparent container for liquid and the decorative liquid therein so as to have bright and colorful visual effect. And the effects of electricity saving, higher safety and decoration all achieved.

It is a primary object of the present invention to provide a LED-type wall lamp with decorative liquid composed by a transparent container for liquid and a base with preset connecting parts respectively. The transparent container for liquid and the base are made respectively and then are assembled together by connecting parts. Various decorative liquid are disposed inside the transparent container for liquid while a circuit board, a plurality of LED lights and plug pins are arranged on the base. There are lots of choices of the decorative liquid inside the transparent container for liquid so as to increase the variability of appearance. Different transparent containers for liquid can be assembled with the same base so that the cost is down.

DETAILED DESCRIPTION OF THE PREFFERED EMBODIMENT

Figure 1:
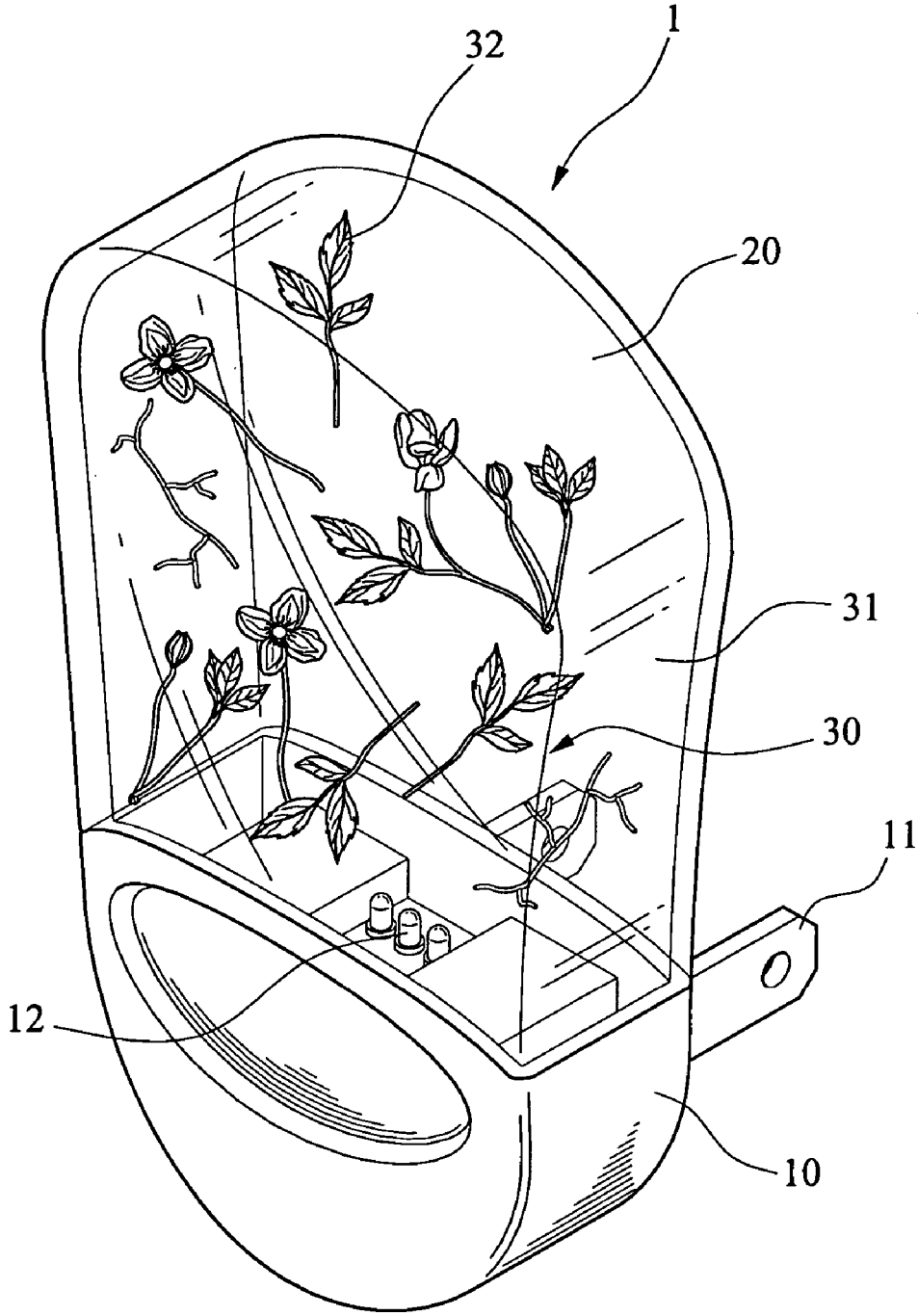
FIG. 1 is a perspective view of the present invention.
Figure 2:
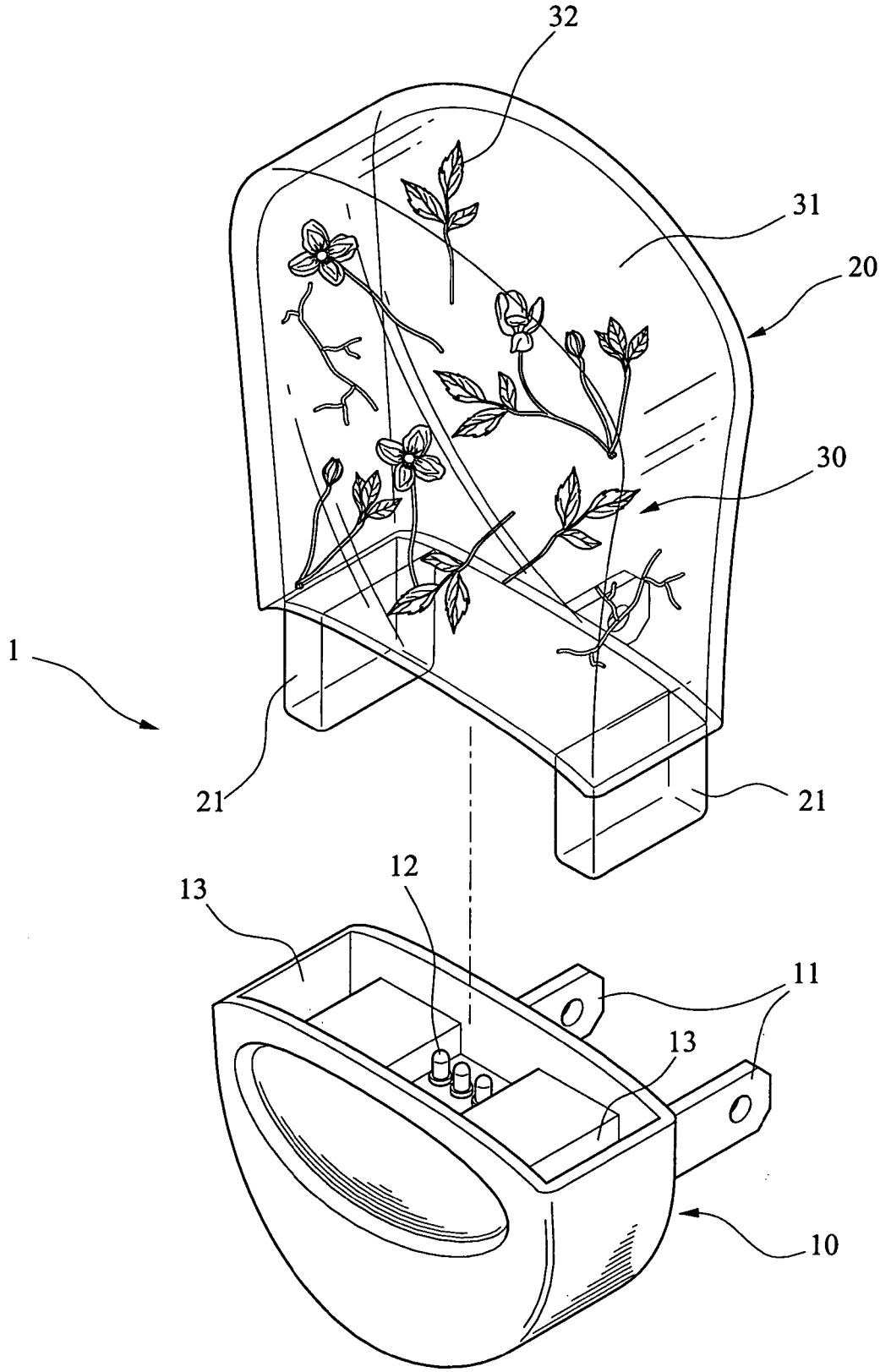
FIG. 2 is an explosive view of the present invention.
Figure 7:
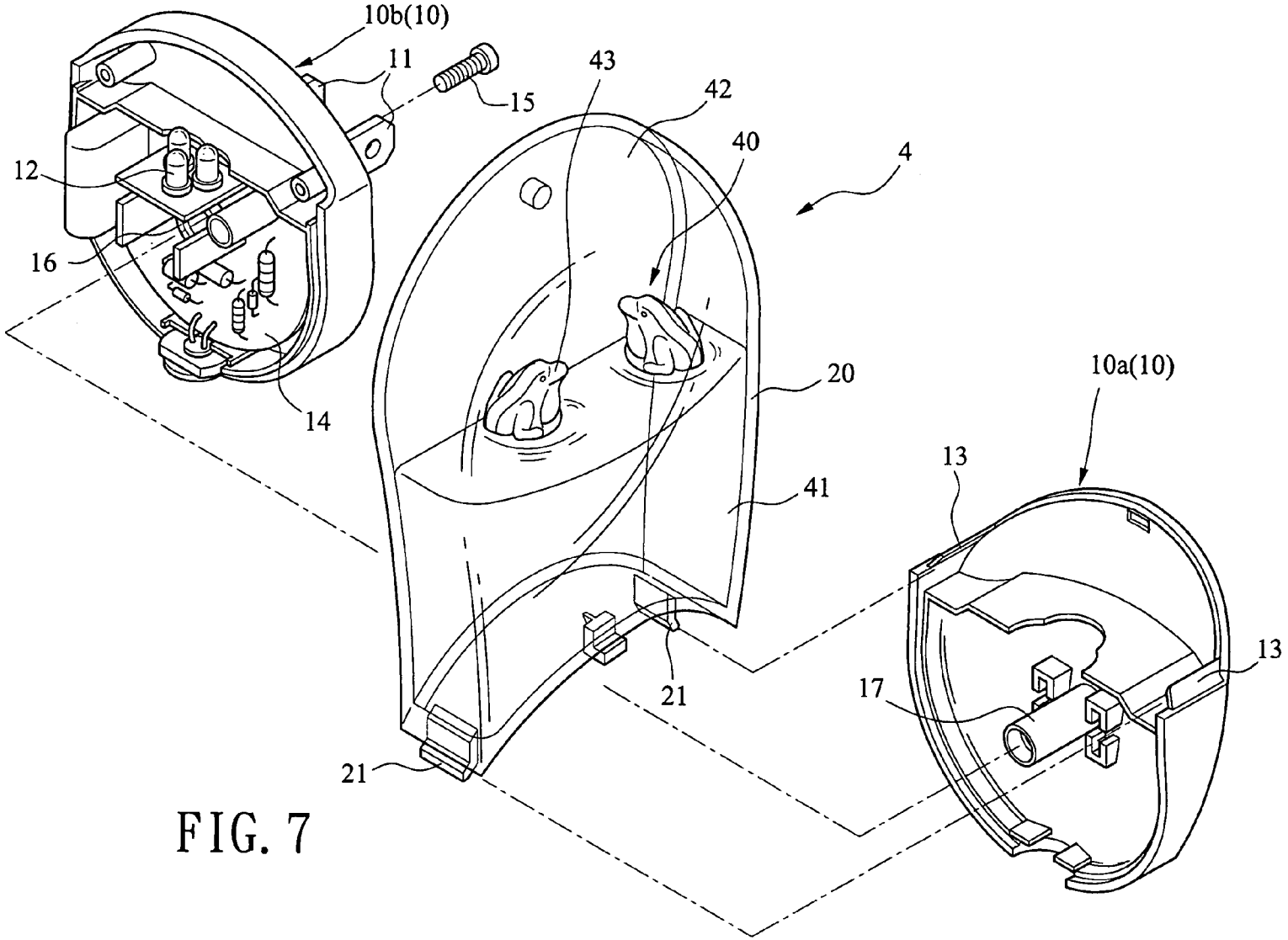
FIG. 7 is an explosive view of the embodiment shown in FIG. 6 in accordance with the present invention.

Refer to FIG. 1 & FIG. 2, a wall lamp (night lamp) 1 of an embodiment in accordance with the present invention consists of a base 10 on the bottom and a transparent container for liquid 20 on the upper side. The base 10 includes a shell, two electric plug pins 11 for connecting with an electric socket, a plurality of LED (light-emitting diode) light 12, and a circuit board 14 (as shown in FIG. 7). The LED lights 12 are with various colors such as red, blue and green. By the circuit board 14, an alternating or interactive illuminative pattern of the LED lights 12 is controlled. For example, the brightness of a LED lamp is getting lighter while the brightness of another LED lamp is getting darker. Thus light with various colors is produced and illuminates the transparent container for liquid 20 so as to increase the variability of the wall lamp 1.

The transparent container for liquid 20 is a closed container made by transparent plastic through injection molding, and ultrasonic weld. The appearance and shapes of the transparent container for liquid 20 are various with a plurality of decorative liquid 30 therein. In FIG. 1 & FIG. 2, the decorative liquid 30 are formed by a transparent liquid 31 and different colorful ornaments 32 such as artificial flowers, seashells, and colorful artificial ice.

The base and the transparent container for liquid 20 are connected with each other by corresponding connecting parts 13, 21, as shown in FIG. 1 & FIG. 2. The connecting part 13 of the base 10 can be a slot (13) arranged on right and left side of the top of the base 10 respectively. While the connecting part 21 of the transparent container for liquid 20 is a projecting object (21) arranged on the right and left sides of the bottom thereof. The projecting object (21) can insert into the slot (13) and match with each other firmly. Thus the base 10 and the transparent container for liquid 20 are made respectively and then are assembled together.

Figure 3:
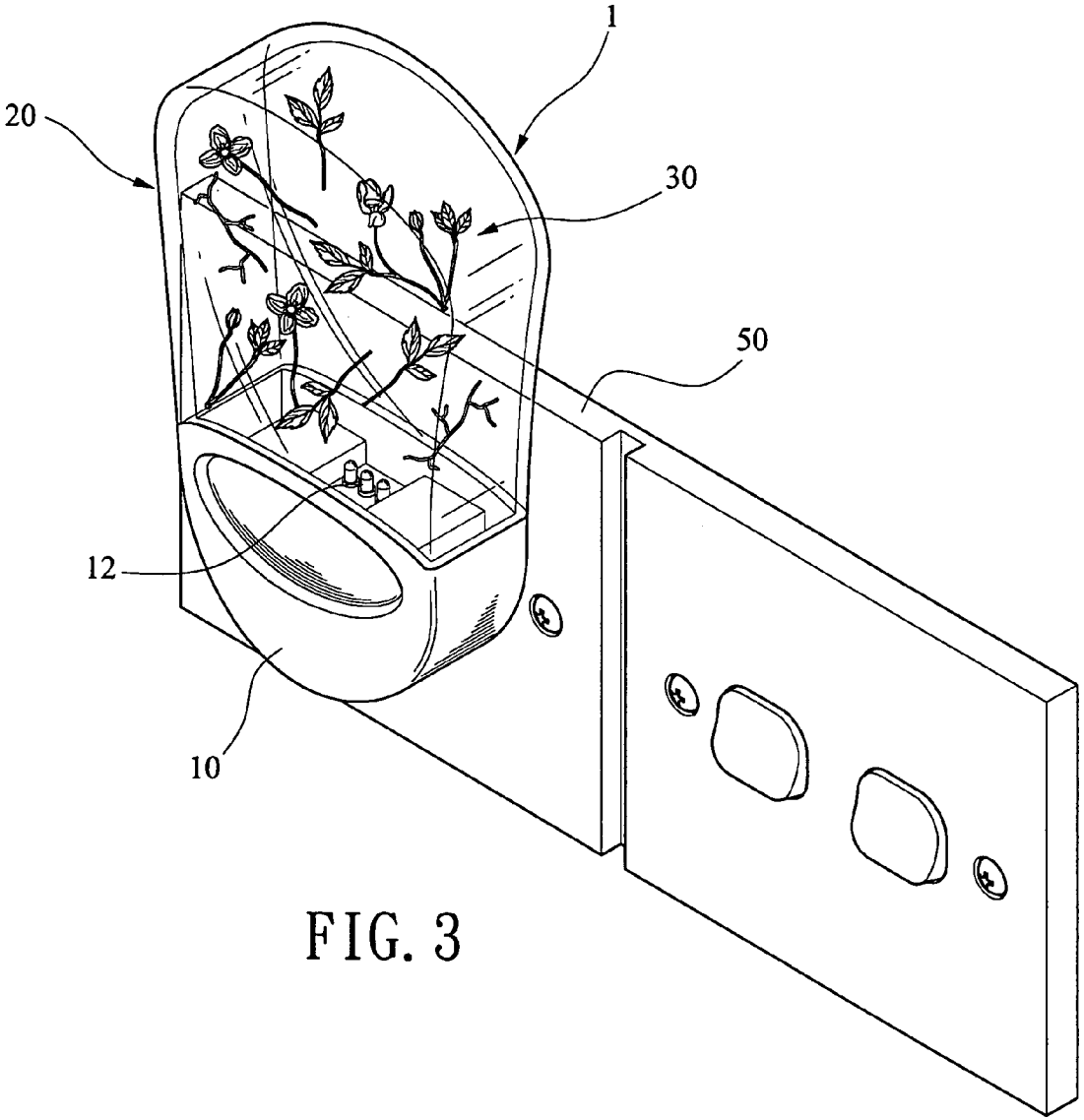
FIG. 3 is an embodiment of the present invention while being used.

Refer to FIG. 3, the wall lamp 1 is inserted onto the electric socket 50, by the plug pins 11. The LED lamps 12 are turned on by a general switch or a sensing switch (not shown in figure) and then light illuminates the transparent container for liquid 20 so that the transparent container for liquid 20 and decorative liquid 30 therein, or double-liquid floater 40 are shining and colorful with better visual effect. Thus the invention has features of electricity-saving, safety, novelty, and decorative effect.

Figure 4:
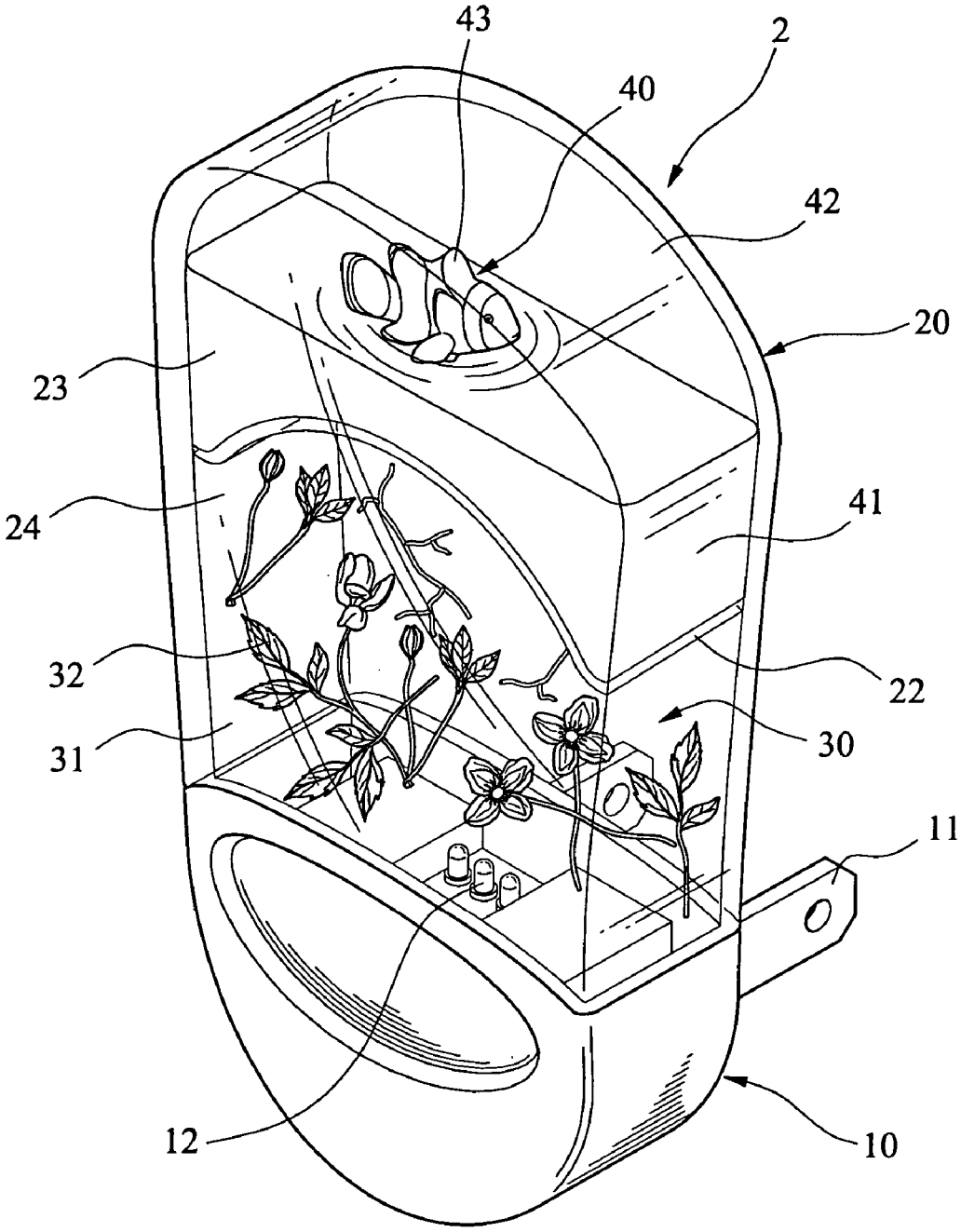
FIG. 4 is a perspective view of another embodiment of the present invention.

Refer to FIG. 4, a wall lamp 2 of another embodiment in accordance with the present invention has the same structure with the wall lamp 1 of the above embodiment, only the shape of the transparent container for liquid 20 varies. The transparent container for liquid 20 is divided into an upper area 23 and a lower area 24 by an isolation plate 22 so as to accommodate decorative liquid 30. For example, a double-liquid floater 40 composed by a dyed lower liquid 41 (such as water in blue color), a transparent upper liquid 42 (such as clear oil) and a floater 43 floating between the upper liquid 42 and the lower liquid 41. The decorative liquid 30 having a transparent liquid 31 and various colorful ornaments 32 are disposed inside the lower area 24.

Figure 5:
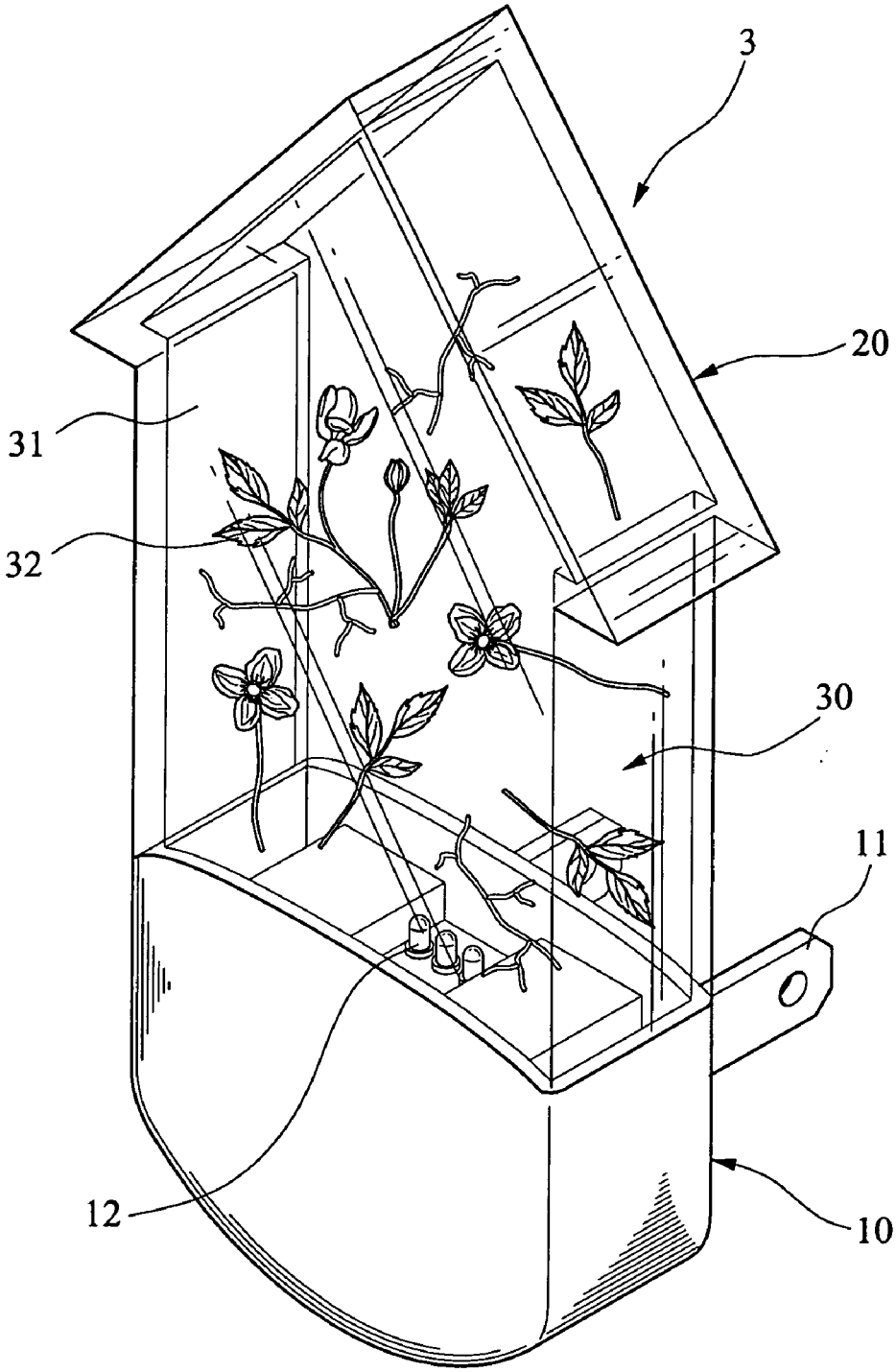
FIG. 5 is a perspective view of a further embodiment of the present invention.

Refer to FIG. 5, a wall lamp 3 of a further embodiment in accordance with the present invention is disclosed. The shapes of the transparent container for liquid 20 and the base 10 are different from that of other embodiments. The transparent container for liquid 20 looks like a house with decorative liquid 30 therein. The decorative liquid 30 consist of a transparent liquid 31 and various kind of colorful ornaments 32.

Figure 6:
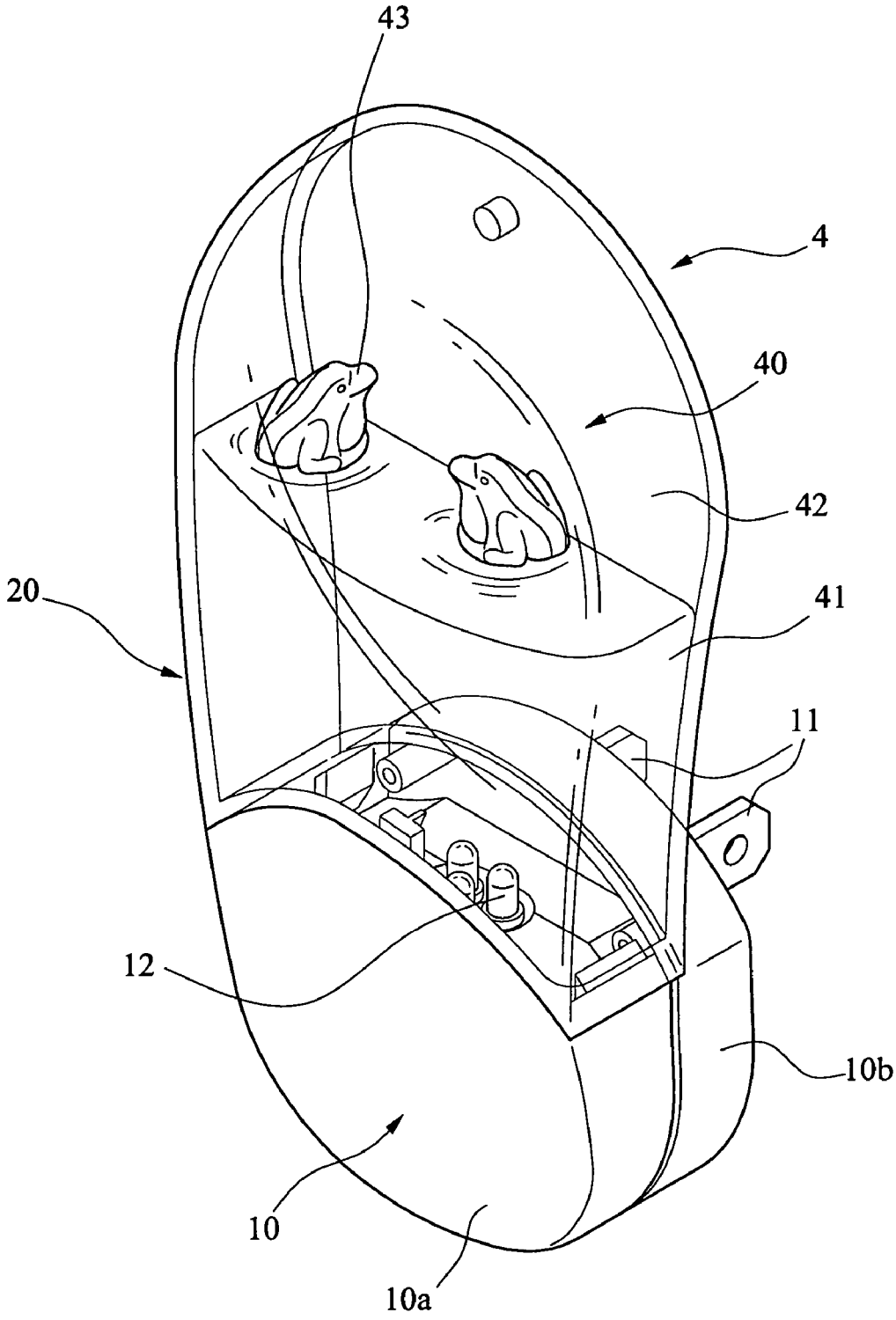
FIG. 6 is a perspective view of a further embodiment of the present invention.

Refer to FIG. 6 & FIG. 7, a wall lamp 4 of a further embodiment in accordance with the present invention has the same structure with the wall lamp 1 of the above embodiment. Only the shapes of the transparent container for liquid 20 and the base 10 are different and the connecting parts 13, 21 are modified. The base 10 is composed by a front half 10*a* and a rear half 10*b*. The connecting part 13 of the base 10 is a stopping piece (13) on the right and left side of the front half 10*a*, slanting toward the center of the front half 10*a*. The connecting part 21 of the transparent container for liquid 20 is a fastening lug (21) disposed on left and right side of the bottom thereof. The two fastening lugs (21) insert on inner side of the two stopping pieces (13) so as to assemble the transparent container for liquid 20 with the base 10. Then a fastening screw 15 inserts through an insertion hole 16 between the two plug pins 11 on the rear half 10*b* and threaded with the inner threads inside a screw base 17 of the front half 10*a* so that the rear half 10*b* against the fastening lugs (21) of the transparent container for liquid 20 firmly and the transparent container for liquid 20 is combined with the front half 10*a* and the rear half 10*b* firmly.

What is claimed is:

1. A LED-type wall lamp with decorative liquid comprising a base on a bottom and a transparent container for liquid on top, wherein the base having a shell, a plurality of electric plug pins, a plurality of LED (light emitting diodes) lights, a circuit board and a connecting pattern of the plurality of LED lights are controlled by the circuit board and light from the LED lights illuminates the transparent container for liquid and a general switch or a sensing switch is disposed on the base for controlling the LED lights;

the transparent container for liquid is a transparent closed container containing said decorative liquid therein, said container having a connecting part corresponding to a connecting part of the base on bottom; and the base and the transparent container for liquid are assembled into a wall lamp and the electric plug pins are connected into an electric socket so as to make the LED lights illuminate the transparent container for liquid, wherein the decorative liquid having a transparent liquid and a plurality of ornaments therein and said LED lights emitting different colors.

2. A LED-type wall lamp with decorative liquid comprising a base on a bottom and a transparent container for liquid on top, wherein the base having a shell, a plurality of electric plug pins, a plurality of LED (light emitting diodes) lights, a circuit board and a connecting pattern of the plurality of LED lights are controlled by the circuit board and light from the LED lights illuminates the transparent container for liquid;

the transparent container for liquid is a transparent closed container containing said decorative liquid therein, said container having a connecting part corresponding to a connecting part of the base on bottom; and the base and the transparent container for liquid are assembled into a wall lamp and the electric plug pins are connected into an electric socket so as to make the LED lights illuminate the transparent container for liquid, wherein the decorative liquid having a dyed lower liquid, a transparent upper liquid and floaters between the upper liquid and the lower liquid.

3. The device as claimed in claim 1, wherein an isolation plate is disposed in the transparent container for liquid so as to divide inner area of the transparent container for liquid into two parts for accommodating different decorative liquid.

* * * * *